US008322997B2

(12) United States Patent
Auer et al.

(10) Patent No.: US 8,322,997 B2
(45) Date of Patent: Dec. 4, 2012

(54) ECCENTRIC PUMP

(75) Inventors: Johann Auer, Losenstein (AT); Stefan Kopf, Reichraming (AT)

(73) Assignee: Weber-Hydraulik GmbH (AT)

( * ) Notice: Subject to any disclaimer, the term of this patent is extended or adjusted under 35 U.S.C. 154(b) by 393 days.

(21) Appl. No.: 12/664,971

(22) PCT Filed: Jun. 6, 2008

(86) PCT No.: PCT/AT2008/000199

§ 371 (c)(1),
(2), (4) Date: Dec. 16, 2009

(87) PCT Pub. No.: WO2008/154665

PCT Pub. Date: Dec. 24, 2008

(65) Prior Publication Data

US 2010/0170377 A1 Jul. 8, 2010

(30) Foreign Application Priority Data

Jun. 18, 2007 (AT) ..... A 937/2007

(51) Int. Cl.
*F04B 1/06* (2006.01)
*F01B 1/00* (2006.01)
*F16D 31/02* (2006.01)

(52) U.S. Cl. ..... 417/221; 92/72; 92/159; 60/445

(58) Field of Classification Search ..... 417/221; 92/72, 159; 60/445
See application file for complete search history.

(56) References Cited

U.S. PATENT DOCUMENTS 2,680,412 A 6/1954 Entwhistle
3,073,178 A * 1/1963 Zubaty et al. ..... 74/571.11
3,073,418 A * 1/1963 Bentley ..... 188/280
3,119,280 A * 1/1964 Mann et al. ..... 74/570.3
4,041,800 A * 8/1977 Sato et al. ..... 74/571.1
4,862,756 A * 9/1989 Dutschke ..... 74/26
5,340,285 A * 8/1994 Reinartz et al. ..... 417/221
5,477,680 A * 12/1995 Heskey et al. ..... 60/452
6,478,548 B1 11/2002 Auer

FOREIGN PATENT DOCUMENTS

DE 2539189 A1 10/1976
DE 19635458 A1 3/1998
EP 1090229 A1 4/2001
WO 9961797 A1 12/1999

OTHER PUBLICATIONS

International Search Report, PCT/AT2008/000199, dated Dec. 19, 2008.

* cited by examiner

*Primary Examiner* — Charles Freay
(74) *Attorney, Agent, or Firm* — Lerner, David, Littenberg, Krumholz & Mentlik, LLP

(57) ABSTRACT

The invention relates to an eccentric pump including a frame, a pump shaft which can be driven using a driving device and is mounted to be rotatable about a main axis that is stationary relative to the frame, an eccentric sleeve which is mounted in an axially movable manner on a pump shaft section, an anti-rotation element which is effective between the pump shaft section and the eccentric sleeve), several pump elements which are stationary relative to the frame and are provided with displacement elements that can be moved in a radial direction relative to the main axis, act upon a fluid contained in swept volumes of the pump elements, and are moved against a fluid pressure by an external surface of the eccentric sleeve, and at least one spring element which acts upon the eccentric sleeve in an axial direction.

20 Claims, 4 Drawing Sheets

ECCENTRIC PUMP

CROSS REFERENCE TO RELATED APPLICATIONS

The present application is a national phase entry under 35 U.S.C. §371 of International Application No. PCT/AT2008/000199, filed Jun. 6, 2008, which claims the benefit of Austrian Patent Application No. A 937/2007, filed Jun. 18, 2007. The disclosures of said applications are incorporated by reference herein.

The invention relates to an eccentric pump, as described in the preamble of claim 1.

From the prior art displacement pumps, in particular radial piston pumps, are known, in which the displacement volume can be influenced actively by the adjustable eccentricity of an eccentric element of the radial piston pump. From patent document EP 1 090 229 B1 of the same applicant a radial piston pump is known, in which the variable eccentricity is achieved by means of an adjusting element adjustable in axial direction which is in the form of an oblique cylinder body. During its operation the forces exerted by the radial piston on the adjusting element or their axial portion are balanced by a spring element acting axially on the adjusting element and in this way depending on the system pressure exerted on the pump elements a specific axial displacement of the adjusting element is achieved against the effect of force of the spring elements. By means of the geometry of the adjusting element in the form of an oblique cylinder body with increasing system pressure and thereby greater axial displacement of the displacement element the eccentricity of the adjusting element becomes lower and the displacement volume of the radial piston pump becomes lower. As the necessary driving power of such a pump is proportional to the product of displacement volume and system pressure, by means of such an arrangement the driving power and thus the drive output and the loading of a drive motor remains largely constant with various system pressures and the drive motor can be set up for lower or largely constant loads, whereby the manufacture of such a radial piston pump becomes more economical.

As the sliding surface cooperating with the pump piston and formed by the external surface of the cylinder body is at an angle to the piston axes, forces act not only on the pump pistons in the direction of the piston axes, but also transverse forces caused by the axial force components, which change back and forth additionally with the rotation of the eccentric shaft in its active direction. By means of these continually changing transverse forces, the pistons of the pump elements are exposed to high loads, whereby the latter either wear rapidly or have to be adapted in a complex or expensive manner to said loads.

The objective of the invention is to provide a displacement pump, which with varying system pressures has largely a constant power requirement, i.e. is self-regulating to a certain degree, and despite this can be equipped with simply designed, inexpensive pump elements, without the latter being stressed excessively.

The objective of the invention is achieved by means of the features in the characterizing part of claim 1, according to which the pump shaft section supporting an eccentric sleeve is designed as an oblique eccentric pin with an eccentric pin axis running in an oblique angle to the main axis of the pump shaft and the eccentric sleeve guided on the eccentric pin has a cylindrical external surface, the generatrices of which run parallel to the main axis.

The adjustable eccentricity of the eccentric sleeve and thus the adjustable displacement volume of the pump elements is achieved by means of the oblique eccentric pin; by means of the cylindrical external surface, the generatrices of which run parallel to the main axis of the pump shaft, at the contact point between the pump pistons and the external surface in relation to the eccentric sleeve axial force components only in the form of frictional forces are exerted during an axial displacement of the eccentric sleeve on the eccentric pin. The transverse forces acting on the pump pistons are thus much smaller than in the prior art and largely negligible, whereby simply constructed and thereby inexpensive pump elements can be used in such displacement pump, without subjecting the latter to excessive demands and wear caused thereby.

By means of the angle of inclination of the eccentric pin in addition to the force exerted by the spring element a centrifugal force acts on the eccentric sleeve rotating with the driven pump shaft, which can drive the eccentric sleeve towards greater eccentricity and therefore supports the spring force. Only in the position in which the centre of gravity of the eccentric sleeve comes to lie exactly in the main axis of the pump shaft does the centrifugal force disappear and the force components affected by this move towards increasing eccentricity. Depending on the position of the eccentric pin axis relative to the main axis of the pump shaft and the displacement possible on the eccentric pin for the eccentric sleeve, such an eccentric pump can control the displacement volume automatically and depending on the existing system pressure, whereby the performance level of the pump drive remains largely constant. The position of the eccentric pin axis relative to the main axis of the pump shaft can also be skewed, if the bore cooperating with the eccentric pins runs in the eccentric sleeve so that the generatrices of the external surface of the eccentric sleeve run parallel to the main axis of the pump shaft.

For the construction and manufacture of such an eccentric pump it is advantageous if the eccentric pin axis intersects the main axis, and also if a central axis of the external surface intersects the eccentric pin axis. In this way simple geometric ratios are obtained and the influences of geometry on the dynamic behavior during operation can be estimated more easily.

Although the eccentric pin can have any cross section that is constant over its length, it is an advantage and simpler for manufacture, if the external surface of the eccentric pin is designed as a circular cylindrical surface with the eccentric pin axis as a circular cylinder axis.

The spring element acting axially on the eccentric sleeve on the pump shaft section is preferably formed by a compression spring or tension spring supported on the pump shaft. Spring elements of this kind are easy to obtain in a large selection and the dynamic behavior of the eccentric sleeve can easily be adjusted by the selection of the spring rate of the spring element. In this way it is possible to provide a spring element, which surrounds the eccentric pin concentrically and is guided on the latter; it is also possible to provide several spring elements, which engage on the eccentric sleeve on a graduated circle distributed outside the eccentric pin.

In order to predefine or exclude certain operating states of the eccentric pump, it is an advantage if the axial implacability of the eccentric sleeve on the eccentric pin is limited at least in one direction by a stop element, and in this way the initial position or start position is defined. A movement delimitation of the eccentric sleeve on the eccentric pin can be achieved for example by the shape of the pump shaft, i.e. in that the pump shaft itself forms a stop element. Similarly, the displacement path can be delimited by a pump housing, also the displacement path can be adjusted, in that the stop element is designed in the form of an adjusting screw.

Advantageous operating behavior of the eccentric pump is achieved if the eccentric sleeve is pretensioned in the start position at a low pressure level in the pump elements by the spring element against the stop element. In the start position with low counterpressure in this way an eccentricity predefined by the start position can be provided and thus a specific displacement volume of the eccentric pump, for example for the idling operation of the eccentric pump, if on the user side there is no increased need for pressure. The start position can be assigned both a maximum displacement volume as well as a minimum displacement volume, which is dependent on the purpose of the eccentric pump.

If the external surface of the eccentric sleeve in the start position has a maximum eccentricity in relation to the main axis, the displacement volume during idling operation at a low pressure level in the pump elements is at the maximum and as described above with increasing system pressure control itself in the direction of smaller displacement volume, whereby the drive output of the eccentric pump remains largely constant. As an alternative to this, it would also be possible, for the eccentric sleeve to have minimum eccentricity in the start position, and the movement of the eccentric sleeve is performed in the direction of increasing eccentricity by means of the centrifugal force acting on the eccentric sleeve.

If the spring detent of the spring element is selected so that during the displacement of the eccentric sleeve from the start position the increase of spring force exerted by the spring element is greater than the removal from the axial component of the centrifugal force acting on the eccentric sleeve, the stable operation of the eccentric pump is ensured, and with an increase in pressure occurring on the consumer side the displacement volume of the eccentric pump can be prevented from dropping too much.

For the operating behavior of the eccentric pump it has proved advantageous to have an angle of inclination between the main axis and the eccentric pin axis from a range with a lower limit of 3° and an upper limit of 20°. An angle of inclination of 10° has proved advantageous for the operating behavior of the eccentric pump in the case of consumer-side pressure fluctuations as well as a compact size of the eccentric pump.

As in the case of a circular cylindrical eccentric pin an additional anti-rotational element is required, this can be formed advantageously by a featherkey connection running parallel to the eccentric pin axis. The latter can be produced easily using proven manufacturing methods and ensures the axial displacement of the eccentric sleeve on the eccentric pin. In the case of an eccentric pin that is not round, for example with a quadratic cross section or polygonal cross section, the anti-rotation element securing can be omitted, whereby however the manufacture of the eccentric pin and the bore cooperating therewith in the eccentric sleeve is again more complicated.

In an embodiment of the eccentric pump with pump elements in only one working plane, i.e. with only one cylinder star, the eccentric pin can be arranged in an assembly-friendly manner to overhang one end of the pump shaft. In this way it is possible for both the eccentric sleeve and the pump shaft to be designed in one piece with the eccentric pin and not have to be assembled.

If the eccentric pin is arranged on a circular cylinder crank cheek of the crankshaft, in particular on a crank cheek concentric to the main axis, the end face of the circular cylindrical crank cheek has a sufficient area to support the spring elements and attach stop elements to limit the axial adjustability of the eccentric sleeve. Furthermore, such a crank cheek forms a relatively large balance weight, which is advantageous for the synchronous operation of such an eccentric pump.

In order to reduce as far as possible wear-promoting sliding movements between the external surface of the eccentric sleeve and the displacement elements of the pump elements, it is an advantage if the eccentric sleeve has a cylindrical roller bearing, the outer ring of which forms the external surface. In this way only small sliding movements occur on the axial displacement of the eccentric sleeve and by the translatory eccentric movement of the external surface in the form of the outer ring in tangential direction. The outer ring of the roller bearing thus has a width, which is greater than the axial displacement path of the eccentric sleeve. As in axial direction there are only very low frictional forces, needle bearings can also be installed.

To supply several consumers, the eccentric pump can also be designed so that along the pump shaft several eccentric pins are arranged, in particular rotationally symmetrically to the main axis, and to each eccentric pin a separate group of pump elements is assigned, in particular a fixed cylinder star comprising several pump elements. The respective pressure lines of the pump elements of a cylinder star are combined to form a common high-pressure connection which is used to supply a consumer. By means of the multiple eccentric pins and cylinder stars several separate high-pressure connections are provided for several consumers, whereby the displacement volumes of the individual cylinder stars can adjust independently of the others to the operating state of the respective consumer. In this way also a common drive motor is charged very evenly for a plurality of consumers.

To supply several consumers simultaneously the eccentric pump can also designed so that on the frame at least two pump shafts are arranged parallel to one another each with at least one eccentric pin, to which a separate group of pump elements is assigned, and can be driven by means of a common drive device. Between the at least two parallel pump shafts by simple means, for example a belt drive, in particular a toothed belt drive, a drive connection is formed and only one drive motor is required, which due to the pump characteristics is charged very evenly.

In order to ensure the low-wearing operation of the eccentric pump it is an advantage if the frame is designed as housing and the pump elements are arranged in the housing containing a lubricant supply. The lubricant can be brought in this way to the contact points at risk of wear by the movements of the pump shaft and in particular at the same time form the pressure medium to be conveyed by the pump elements. The pump elements can thus suction directly from the pressure medium supply, which is also the lubricant supply, inside the housing.

The pump elements of the eccentric pump advantageously comprise spring elements, which pretension the displacement elements radially in the direction of the main axis against the external surface of the eccentric sleeve. The displacement elements in the form of piston elements or membrane elements can in this way perform automatically the suctioning of pressure medium into the displacement volumes of the pump elements, without tensile forces having to be exerted by the eccentric sleeve on the displacement elements. This results in a simple structure of the eccentric pump.

In order during the operating cycle of the pump elements to prevent a backflow of pressure medium to the suction side, suction valves, in particular disc bearing valves are arranged between the displacement volumes in the pump elements and a pressure medium supply. Likewise pressure valves, in particular disc bearing valves, are arranged advantageously between the displacement volumes in the pump elements and a high-pressure connection of the eccentric pump, whereby during the suction cycle the backflow of pressure medium from the high-pressure side to the displacement volumes is prevented.

As an alternative to this the control of the pump elements, i.e. the pressure medium inflow or the pressure medium outflow in or out of the displacement volumes of the pump elements is performed by means of a gate control, which may be advantageous at lower operating speeds of an eccentric pump.

To achieve the highest operating pressures of such an eccentric pump the latter can be designed in particular in the form of a radial piston pump, in which the displacement elements are designed as pump pistons guided in pump cylinders. By means of such a design operating pressures of over 500 bar, for example 700 bar, can be generated easily.

The invention also relates to a salvaging device comprising a hydraulic system as well as salvage cutters or a salvage spreader driven by the latter, characterized in that the hydraulic system comprises an eccentric pump according to the invention. Hydraulic consumers, such as salvage cutters or salvage spreaders, are characterized in that on the one hand during operation with unloaded tools they require rapid movements and thus large stroke volumes, but on the other hand they require very high operating pressures from the engagement of the tools, at which rapid tool movement and large stroke volumes are no longer required. By means of the eccentric pump according to the invention as a hydraulic drive for such a salvaging device the drive motor for the eccentric pump can be utilized to an optimum degree in all operating states and in this way a more inexpensive drive motor can be used.

The invention also relates to a method for driving a fluid-driven motor, such as a hydraulic cylinder or a hydraulic motor, by means of a pressure medium flow, which is characterized in that the pressure medium flow is provided by an eccentric pump according to the invention. By means of the self-regulating operation of the eccentric pump its drive motor in all operating states is respectively within the range of the optimum operating point and optimum performance.

The invention is explained in more detail in the following with reference to the exemplary embodiments shown in the drawings.

In a simplified, schematic view

Figure 3B:
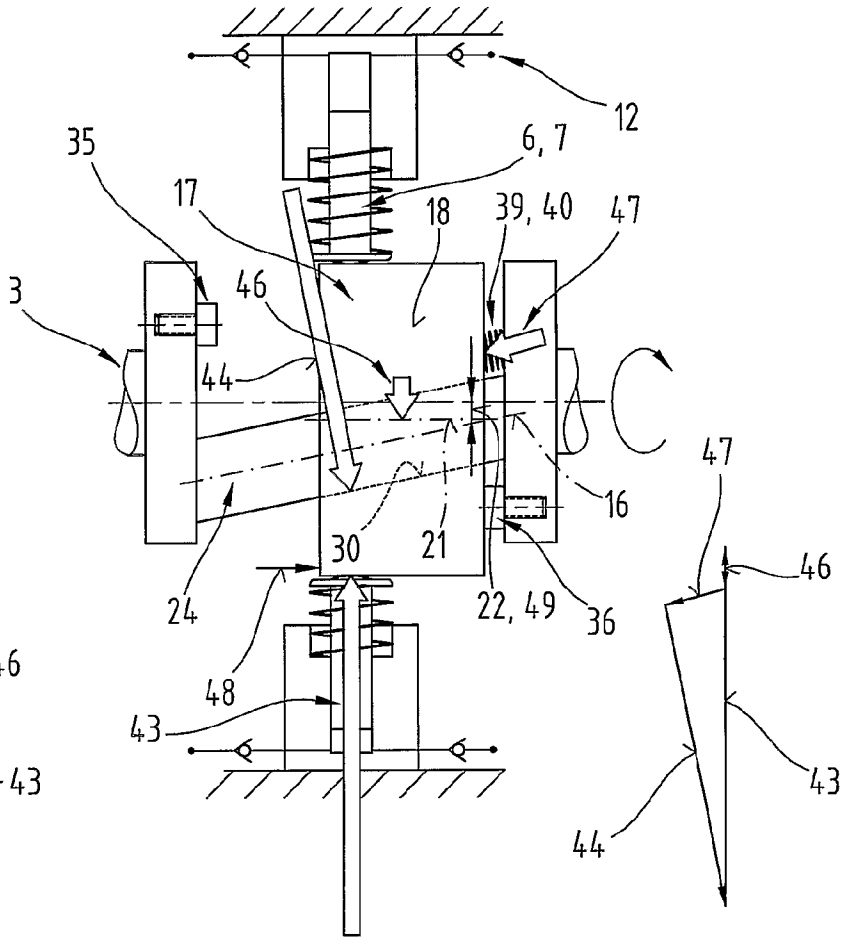
Figure 3A:
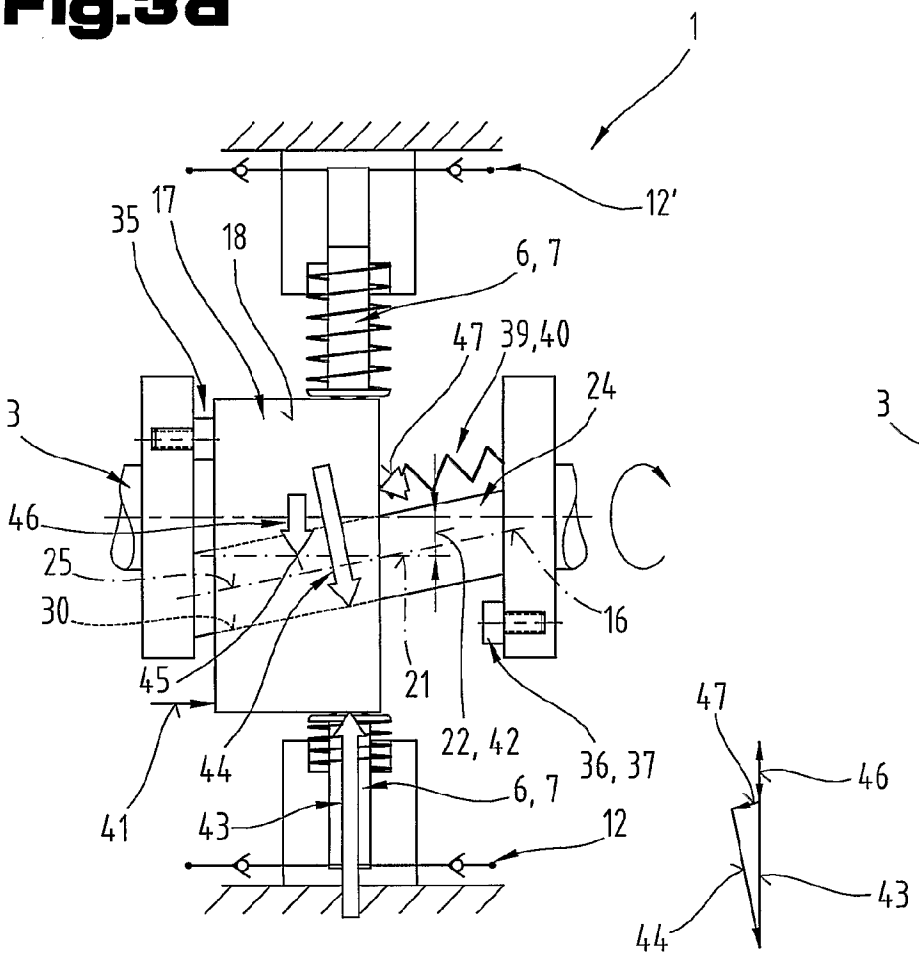
Figure 4:
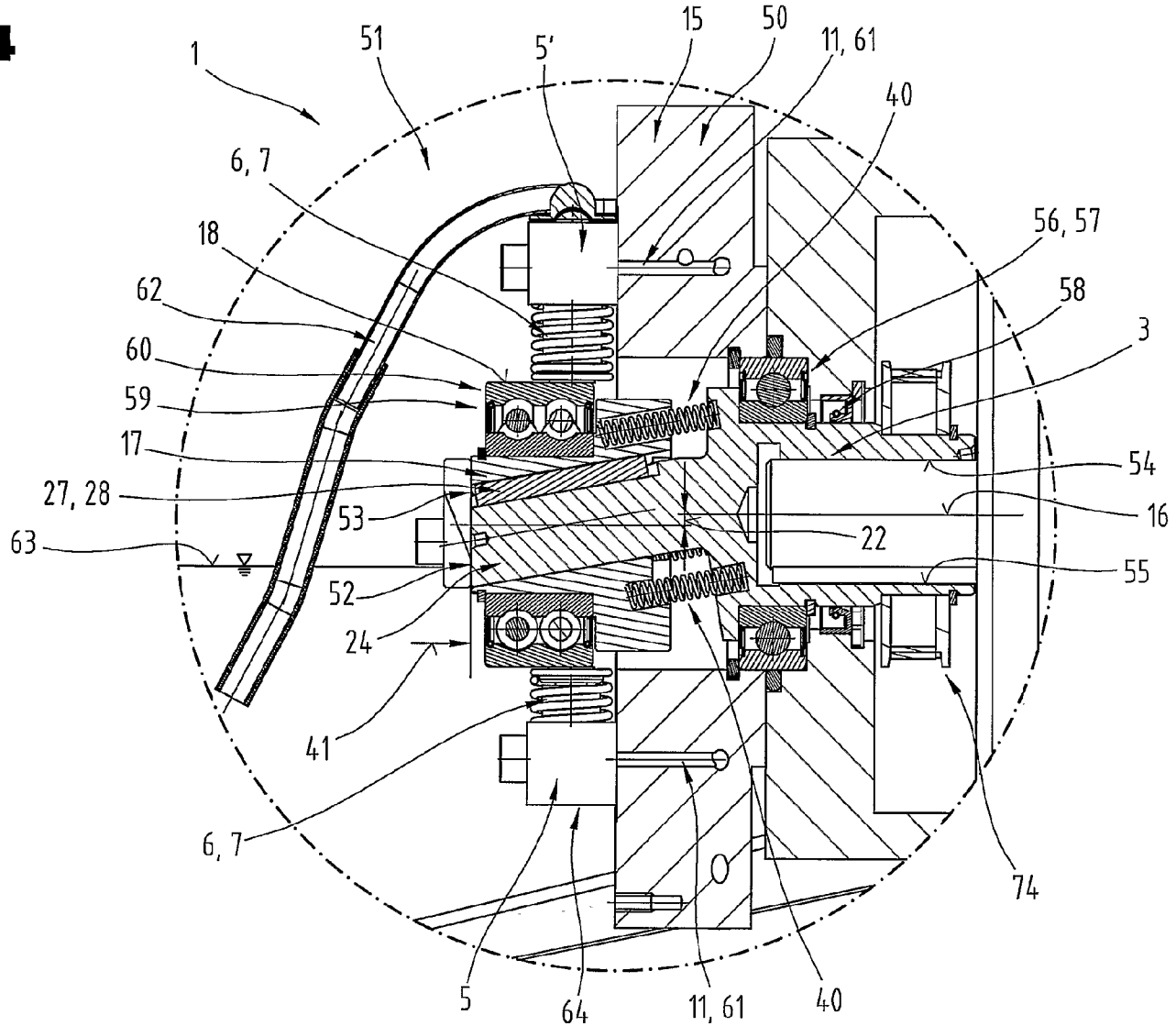
Figure 5:
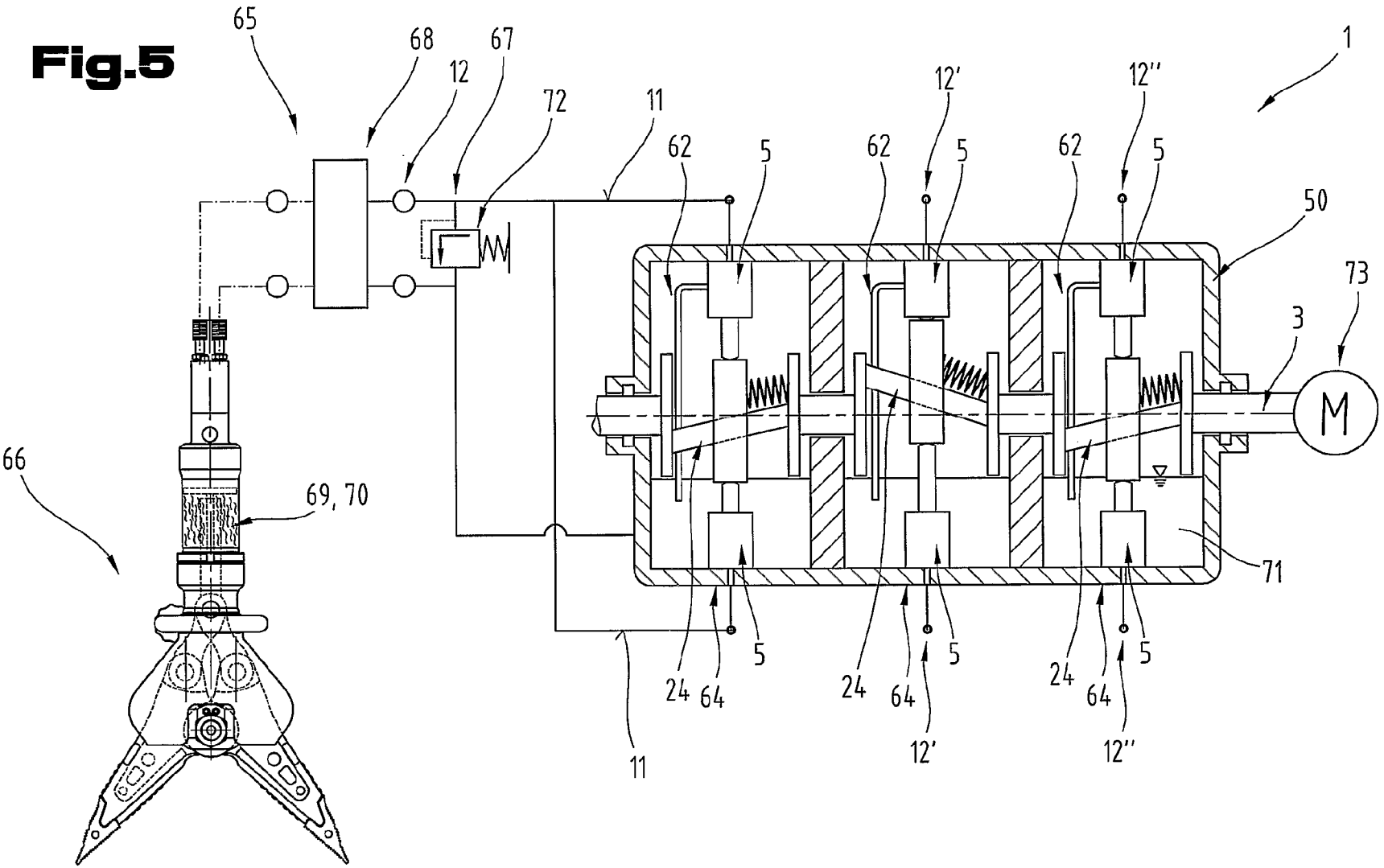

FIG. 3*a* shows a view of the forces acting in a first operating state on the eccentric sleeve;

FIG. 3*b* shows a view of the forces acting in a second operating state on the eccentric sleeve;

FIG. 4 shows a cross section of another embodiment of an eccentric pump according to the invention in the form of a radial piston pump;

FIG. 5 shows a salvage device with an eccentric pump according to the invention.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position. Furthermore, also individual features or combinations of features from the various exemplary embodiments shown and described can represent in themselves independent or inventive solutions.

All of the details relating to value ranges in the present description are defined such that the latter include any and all part ranges, e.g. a range of 1 to 10 means that all part ranges, starting from the lower limit of 1 to the upper limit 10 are included, i.e. the whole part range beginning with a lower limit of 1 or above and ending at an upper limit of 10 or less, e.g. 1 to 1.7, or 3.2 to 8.1 or 5.5 to 10.

Figure 2:
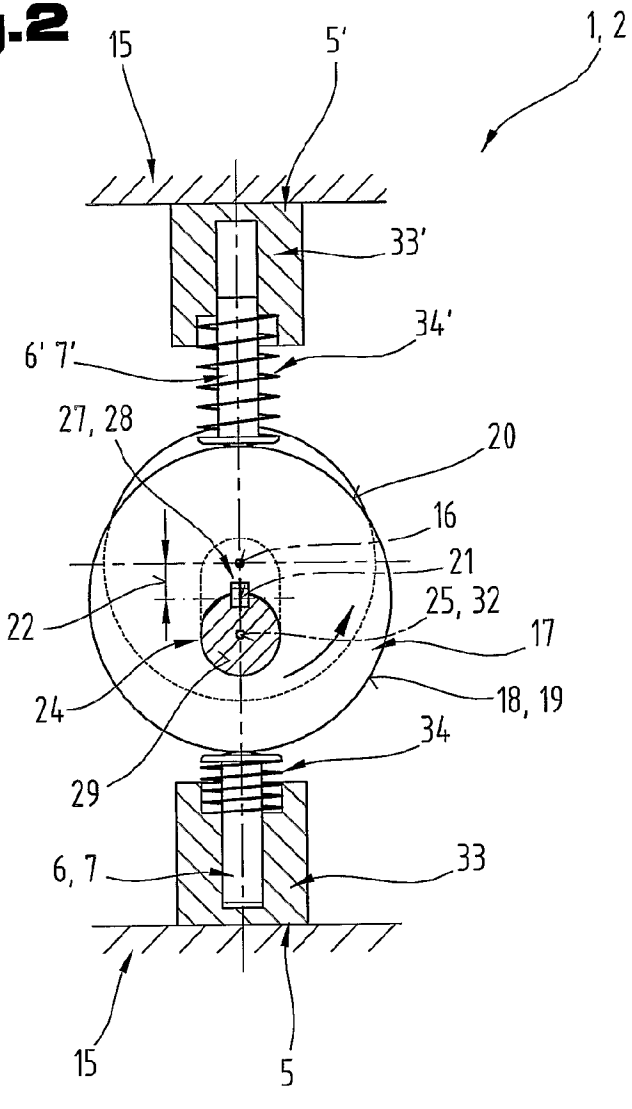
FIG. 2 shows a view of the eccentric pump according to FIG. 4 in the direction of the pump shaft axis.
Figure 1:
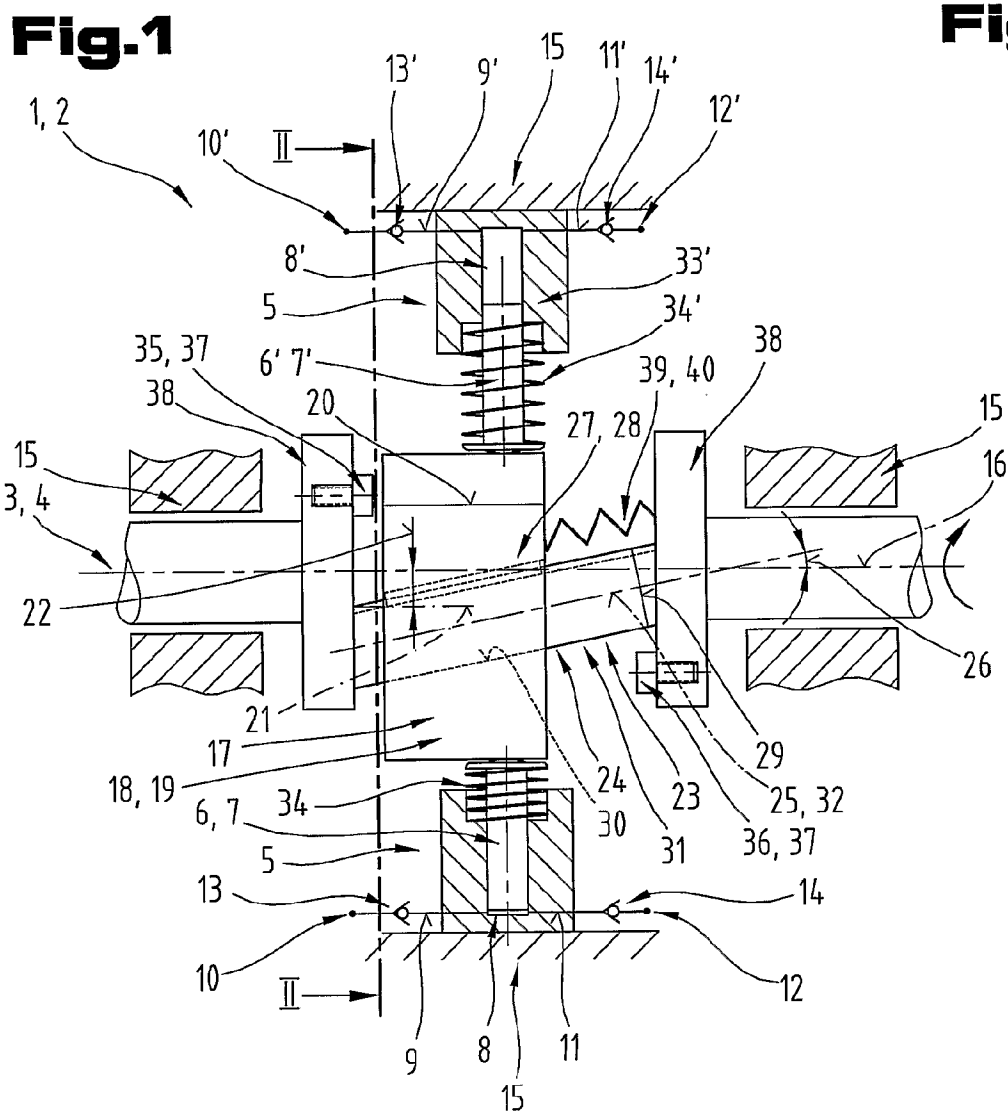
FIG. 1 shows a cross section of an eccentric pump according to the invention in the form of a radial piston pump.

FIGS. 1 and 2 show the structure and functioning of an eccentric pump 1 according to the invention in the form of an externally charged radial piston pump 2. The latter comprises essentially a pump shaft 3, which can also be referred to as an eccentric shaft 4. This causes, with rotation on pump elements 5, 5' arranged peripherally to the eccentric shaft 4, in the displacement element 6, 6', in the form of pump pistons 7, 7', the piston stroke volumes 8, 8', to reduce and increase in size periodically. With each operating cycle of a displacement element 6 pressure medium or hydraulic fluid is suctioned by a suction line 9, 9' from a pressure medium supply 10 by increasing the displacement volume 8 and delivered by reducing the size of the displacement volume 8 via a pressure line 11 to a high-pressure connection 12, from which a consumer, such as e.g. a fluid-driven motor in the form of a hydraulic cylinder, a hydraulic motor or the like is supplied. The control of the flow of pressure medium through the pump elements 5, 5' is performed by means of suction valves 13, 13' and pressure valves 14, 14', which control the flow direction of the pressure medium to and from the displacement volumes 8, 8'. The suction valves 13 and the pressure valves 14 can for example be designed in the form of disc bearing valves or other types of valve.

The pump shaft 3 and the pump elements 5; 5' are mounted to be stationary in relation to a frame 15, which is designed for example as a housing. The word frame 15 in this context does not relate to the construction but to the kinematic function as a reference system relative to which the pump shaft 3 and displacement elements 6; 6' of the pump element 5; 5' move. The pump shaft 3 is driven by a drive device not shown in FIG. 1 and executes during operation a rotation about a main axis 16. The periodic operation of the displacement elements 6; 6' is performed by an eccentric sleeve 17; the external surface 18 of which rotates eccentrically about the main axis 16. The external surface 18 of the eccentric sleeve 17 has in the shown exemplary embodiment the form of a circular cylindrical surface 19, the generatrices 20 of which are parallel to the main axis 16, whereby a central axis 21 of the circular cylinder surface 19 runs parallel to the main axis 16. The distance between the central axis 21 and the main axis 16 results in the eccentricity 22 of the eccentric sleeve 17 relative to the main axis 16 and also corresponds to half the stroke of the displacement elements 6.

In the eccentric pump 1 according to the invention the eccentricity 22 can be varied, for which reason the eccentric sleeve 17 is mounted axially adjustably on a pump shaft section 23, which is designed as an eccentric pin 24, the eccentric pin axis 25 of which has an angle of inclination 26 to the main axis 16. This angle of inclination 26 in the exemplary embodiment shown is about 10°, but preferably can be selected from a range with a lower limit of 3° and an upper limit of 20°. By means of the angle of inclination 26 between the eccentric pin axis 25 and the main axis 16, an axial displacement of the eccentric sleeve 17 on the eccentric pin 24 causes a change in the eccentricity 22, i.e. the distance between the central axis 21 of the external surface 18 and the main axis 16 changes upon the axial displacement of the eccentric sleeve 17. For transmitting the drive moment an anti-rotation element 27 is provided between the eccentric pin 24 and the eccentric sleeve 17, in the shown exemplary embodiment this is in the form of a featherkey connection 28. Alternatively, any kind of anti-rotation element 27 can be formed, which allows the axial movement of the eccentric sleeve 17 along the eccentric pin 24, for example a cross-sectional surface 29 of the eccentric pin 24 deviating from a circular shape and a recess or bore 30 in the eccentric sleeve 17 acting in an anti-rotational manner therewith. The cross section of the eccentric pin 24 can be designed for example to have a wedge shaft profile or a polygonal profile.

In the exemplary embodiment shown the eccentric pin 24 is designed as a circular cylinder section 31, the circular cylindrical axis 32 of which forms the eccentric pin axis 25. Alternatively to this the eccentric pin 24 can also have an angular, for example a quadratic cross section.

As an alternative to the shown exemplary embodiment the external surface 18 of the eccentric sleeve 17 can have a cross section differing from a circular shape that is oval for example or has flattened parts, whereby the cross sectional form can be used to obtain the desired characteristics of the eccentric pump 1.

The displacement elements 6 in the form of pump pistons 7 are guided in pump cylinders 33 and are pressed by piston springs 34 against the external surface 18 of the eccentric sleeve 17 or at least in the direction of the main axis 16. The piston springs 34 are selected so that the suction cycle of the pump elements 5 is performed automatically by the displacement elements 6. As an alternative to the pump pistons 7 membrane elements can also be used as displacement elements 6, 6'. Instead of using piston springs 34 for the pump pistons 7 or generally using spring elements for the displacement elements 6 the displacement elements 6 can also perform the suction cycle by means of tension forces, if an articulated connection suitable for transmitting tensile forces is provided between displacement elements 6 and the eccentric sleeve 17. The eccentric sleeve 17 can be provided in this case with an external sleeve which performs only the translatory eccentric movement but not the rotational movement.

The axial displacement path of the eccentric sleeve 17 on the eccentric pin 24 is limited in FIG. 1 on the left side by a first stop element 35 and to the right side by a second stop element 36, whereby a screw element 37 is used as the stop element 35, 36, which is used on the crank cheeks 38 of the pump shaft 3. The crank cheeks 38 in the shown exemplary embodiment have the form of disc-like circular cylindrical sections.

Between the eccentric sleeve 17 and crank cheek 38 arranged to the right thereof in FIG. 1 a spring element 39 in the form of compression spring 40 is arranged, which exerts a spring force in axial direction on the eccentric sleeve 17. The spring element 39 can in this way be oriented as shown parallel to the eccentric pin axis 25, but can for example also be oriented parallel to the main axis 16 or in another direction, as long as the spring force can exert on the eccentric sleeve 17 a force component parallel to the direction of the eccentric pin axis 25. As the spring element 39 in the shown exemplary embodiment is designed as a compression spring 40, the spring force also acts on the eccentric sleeve 17 to the left and the eccentric sleeve 17 is pushed to the left against the first stop element 35, if the forces exerted by the pump pistons 7 are low, whereby an start position or initial position is defined.

During the operation of the eccentric pump 1 the radial piston forces exerted by the pump pistons 7, the axial spring force exerted by the spring element 39, a centrifugal force in radial direction caused by the eccentricity of the centre of gravity of the eccentric sleeve 17 relative to the main axis 16 and a contact force acting between the eccentric pin 24 and eccentric sleeve 17 that is radial in relation to the eccentric pin axis 25 act on the eccentric sleeve 17 with the disappearance of frictional forces.

The cooperation of the forces acting on the eccentric sleeve 17 and the function of the eccentric pump 1 is explained in the following with reference to FIGS. 3*a* and 3*b*.

FIG. 3*a* shows the section of an eccentric pump 1 according to the invention, in which the eccentric sleeve 17 is pressed by means of the spring element 39 in the form of a compression spring 40 against the left stop element 35 and thereby adopts a start position 41. In the start position 41 the eccentricity 22 between the central axis 21 of the eccentric sleeve 17 and the main axis 16 of the pump shaft 3 corresponds to a maximum eccentricity 42, which provides the maximum stroke of the displacement elements 6, 6' in the form of pump pistons 7, 7' and in this way the maximum displacement volume of the eccentric pump 1.

In the following the operating state of the eccentric pump 1 is considered, in which the contact force between the eccentric sleeve 17 and the left stop element 35 disappears and the eccentric sleeve 17 stands to the right immediately before an axial displacement on the eccentric pin 24. With the disappearance of frictional forces the following forces act on the eccentric sleeve 17 in a simplified manner:

1. a resulting piston force 43, which is directly proportional to the system pressure at the high-pressure connections 12, 12'. The forces caused by the piston springs 34, 34' can be disregarded in this connection, as for the most part they cancel one another out;
2. a contact force 44 transmitted between the eccentric pin 24 and the bore 30 of the eccentric sleeve 17, which is directed at right angles to the eccentric pin axis 25;
3. a centrifugal force 46 acting in a simplified manner on the centre of gravity 45 of the eccentric sleeve 17, which is directed at right angles to the central axis 21 of the eccentric sleeve 17; and
4. a spring force 47 exerted by the spring element 39, which force is directed parallel to the eccentric pin axis 25.

In this operating state the component of the piston force 43 acting axially relative to the eccentric pin axis 25 is equalized by the opposing axial components of the centrifugal force 46 and the spring force 47. The corresponding forces polygon is also shown in FIG. 3*a*. If the system pressure at the high-pressure connections 12, 12' remains unchanged in this operational state, the forces acting on the eccentric sleeve 17 are in equilibrium and the eccentric sleeve 17 rotates further in the illustrated start position 41.

If there is now an increase in pressure at the high-pressure connections 12, 12' it is clear that in this way also the resulting piston force 43, which acts on the external surface 18 of the eccentric sleeve 17, increases and the component of piston force 43 axial to the eccentric pin axis 25 causes a displacement of the eccentric sleeve 17 to the right, until the increase of the axial components of the piston force 43 is equalized by an increase in the spring force 47 caused by the axial displacement and a new state of equilibrium is formed with an eccentric sleeve 17 displaced to the right relative to the start position.

By means of this displacement of the eccentric sleeve 17 along the oblique eccentric pin 24 the eccentricity 22 is reduced and thereby also the stroke of the pump piston 7, whereby the displacement volume of the eccentric pump 1 is reduced at a constant driving speed relative to the displacement volume in the start position 41 of the eccentric sleeve 17.

In the described new balanced position the system pressure to be supplied by the eccentric pump 41 is higher than in the start position 41, but the volume flow is lower, whereby the drive output required for the eccentric pump 1 remains mostly constant, as the latter is proportional to the product of the system pressure and volume flow and their changes cancel one another out. An increase in the system pressure at the high-pressure connections 12 thus causes a displacement of the eccentric sleeve 17 towards lower eccentricity 22, i.e. in the shown exemplary embodiment to the right and a reduction in the system pressure 12 at the high-pressure connections 12 causes a displacement of the eccentric sleeve 17 in the direction of increasing eccentricity, i.e. in the shown exemplary embodiment to the left and in fact by the spring force 47 of the spring element 39. Theoretically, an unrestricted increasing pressure at the high-pressure connections 12 due to the continually increasing piston force 43 would cause a displacement of the eccentric sleeve 17 so far to the right, until the eccentricity 22 disappears and the volume flow of the eccentric pump 1 approaches zero. As such an operating state is undesirable in practice, the displacement path of the eccentric sleeve on the eccentric pin 24 is limited to the right by a second stop element 36.

FIG. 3*b* shows an operating state of an eccentric pump 1, in which the eccentric sleeve 17 has just adopted the end position 48 of its maximum displacement along the eccentric pin 24 and comes into contact with the right, second stop element 36. In this operating state the resulting piston force 43, which is much greater in this operating state than in the start position 41, and the much greater contact force 44 between the eccentric pin 24 and the bore 30 in the eccentric sleeve 17, and the centrifugal force 46 reduced by the reduced eccentricity 22 as well as the increased spring force 47 act on the eccentric sleeve 17, which equalizes the axial components of the piston force 43 and the centrifugal force 47. The cooperation of forces is shown in a simplified manner in a separate forces polygon.

In this end position 48 the eccentricity 22 between the central axis 21 of the external surface 18 of the eccentric sleeve 17 and the main axis 16 of the pump shaft 3 corresponds to a minimum eccentricity 49, which also determines the minimum displacement volume per rotation of the eccentric pump 1.

The operational behavior of such an eccentric pump 1 can thus be influenced in broad ranges, for example by the selection of the angle of inclination 26, the position and size of the adjustment path of the eccentric sleeve 17 on the eccentric pin 24, the characteristic curve of the spring and the pretensioning of the spring element 39, the maximum eccentricity 42 and minimum eccentricity 49.

FIG. 4 shows in sections a cross section of another embodiment of an eccentric pump 1 according to the invention, in which the frame 15 is designed as a housing 50, the pump shaft 3 is guided into the inside of the housing 51 and at one end 52 of the pump shaft 3 the eccentric sleeve 17 is mounted axially displaceably on the overhanging eccentric pin 24 forming the end 52 of the pump shaft. FIG. 4 shows the eccentric sleeve 17 in the start position 41, in which the latter is pretensioned by several compression springs 40 against an end disc 53 secured to the end 52 of the eccentric pin 24. The part of the pump shaft 3 lying outside the housing 50 has a shaft bore 54 with a featherkey way 55, whereby the pump shaft can be connected simply to a not shown drive motor. The pump shaft 3 is mounted in the housing 50 by roller bearings 56 in the form of radial ball bearings 57 and the inside of the housing 51 is sealed off from the environment by means of shaft seals 58.

To the inside of the housing 50 on a graduated circle in relation to the main axis 16 of the pump shaft 3 several pump elements 6 are secured, which in radial direction comprise actuable displacement elements 6 in the form of pump pistons 7. The functioning of the pump elements 5 has already been described with reference to FIG. 1 and is not repeated at this point.

In order to reduce the wear caused by the sliding between the external surface 18 of the eccentric sleeve 17 and the pump piston 7, the eccentric sleeve 17 has a cylindrical roller bearing 59, the outer ring 60 of which forms the external surface 18 of the eccentric sleeve. By means of this rotatable roller bearing of the outer ring 60 the latter does not execute like the eccentric sleeve 17 an eccentric rotation with respect to the main axis 16, but executes, when the rolling friction between the outer ring and inner ring is negligible a circular translation relative to the main axis 16, whereby the diameter of this circular movement corresponds to twice the eccentricity 22. The anti-rotation element 27 between the eccentric sleeve 17 and the eccentric pin 24 is formed by a featherkey connection 28.

The pressure lines 11 leading away from the displacement spaces 8 into the pump elements 5 are formed by corresponding bores 61 and are joined together into a common high-pressure connection to supply a consumer, whilst the suction lines 9 end inside the housing 51, in which there is an adequate supply of the pressure medium, whereby the housing 50 has the function of a tank in an open hydraulic circuit. As shown in FIG. 4, the suction line 9 for a pump element 5 arranged above the fluid level—comprises a suction pipe 62, which is guided until below the fluid level 63.

The functioning of the eccentric pump 1 shown in FIG. 4 corresponds to the functioning described with reference to FIG. 3*a* and FIG. 3*b* and is not described in detail here to avoid repetition. The pump elements 5 can be arranged on a graduated circle in relation to the main axis 16, and to ensure as few as possible pressure fluctuations at the high-pressure connection 12 can be combined into common connection and distributed evenly over the circumference of the graduated circle. According to the structural size of the pump elements 5 for example 4 to 9 pump elements 5 can be assigned to an eccentric sleeve 17 and with their star-like arrangement can form a so-called cylinder star 64.

FIG. 5 shows as an example of the use of an eccentric pump 1 according to the invention a salvage device 65 comprising salvage cutters 66 or a salvage spreader and a hydraulic system 67 with the eccentric pump 1 according to the invention and a hydraulic control 68 for controlling the fluid flow to or from the salvage cutters 66. The salvage cutters 66 comprise a fluid-driven motor 69 in the form of a hydraulic cylinder 70, which converts the hydraulic means flow into movements of the salvage tools. The pressure medium flow is provided by an eccentric pump 1, in which the pump shaft 3 comprises several eccentric pins 24, three in the exemplary embodiment shown, to each of which a cylinder star 64 comprising several pump elements 5 is assigned. The pressure lines 11 of the pump elements 5 of each cylinder star 64 are combined to form a common high-pressure connection 12. By means of the three cylinder stars 64 thus three high-pressure connections are provided, one of which is connected by the hydraulic control 68 to the consumer in the form of the salvage cutters 66 and two further high-pressure connections 12', 12" are provided for additional consumers. The suction lines 9 of the upper pump elements 5 are connected via suction tubes 62 to the pressure medium supply 71 contained in the housing 50. In order to protect the eccentric pump 1 from damaging pressure peaks the hydraulic system comprises a pressure limit valve 72. The drive of the pump shaft 3 is performed by a drive device 73 indicted only symbolically, for example in the form of an electric motor.

Furthermore, FIG. 4 shows the possibility of the pump shaft 3 driven by means of a drive device 73 driving one or more additional, not shown, pump shafts by means of a toothed belt drive 74, in which several eccentric pump units can be driven by only one drive motor and separate hydraulic circuits are made available for several consumers.

The exemplary embodiments show possible embodiment variants of the eccentric pump 1, whereby it should be noted at this point that the invention is not restricted to the embodiment variants shown in particular, but rather various different combinations of the individual embodiment variants are also possible and this variability, due to the teaching on technical procedure, lies within the ability of a person skilled in the art in this technical field. Thus all conceivable embodiment variants, which are made possible by combining individual details of the embodiment variants shown and described, are also covered by the scope of protection.

Finally, as a point of formality, it should be noted that for a better understanding of the structure of the eccentric pump the latter and its components have not been represented true to scale in part and/or have been enlarged and/or reduced in size.

Mainly the individual embodiments shown in FIGS. 1, 2; 3*a*, 3*b*; 4; 5 can form the subject matter of independent solutions according to the invention. The objectives and solutions according to the invention relating thereto can be taken from the detailed descriptions of these figures.

LIST OF REFERENCE NUMERALS

1 Eccentric pump
2 Radial piston pump
3 Pump shaft
4 Eccentric shaft
5 Pump element
6 Displacement element
7 Pump piston
8 Displacement volume
9 Suction line
10 Pressure medium supply
11 Pressure line
12 High-pressure connection
13 Suction valve
14 Pressure valve
15 Frame
16 Main axis
17 Eccentric sleeve
18 External surface
19 Circular cylinder surface
20 Generator
21 Central axis
22 Eccentricity
23 Pump shaft section
24 Eccentric pin
25 Eccentric pin axis
26 Angle of inclination
27 Anti-rotation element
28 Featherkey connection
29 Cross-sectional surface
30 Bore
31 Circular cylinder section
32 Circular cylinder axis
33 Pump cylinder
34 Piston spring
35 Stop element
36 Stop element
37 Screw element
38 Crank cheek
39 Spring element
40 Compression spring
41 Start position
42 Maximum eccentricity
43 Piston force
44 Contact force
45 Centre of gravity
46 Centrifugal force
47 Spring force
48 End position
49 Minimum eccentricity
50 Housing
51 Inside of housing
52 End
53 End disc
54 Shaft bore
55 Featherkey way
56 Roller bearing
57 Radial ball bearing
58 Shaft seal
59 Roller bearing
60 External ring
61 Bore
62 Suction pipe
63 Fluid level
64 Cylinder star
65 Salvage device
66 Salvage cutters
67 Hydraulic system
68 Hydraulic control
69 Motor
70 Hydraulic cylinder
71 Pressure medium supply
72 Pressure limit valve
73 Drive device
74 Toothed belt drive

The invention claimed is:

1. A pump comprising a frame, a pump shaft which can be driven using a driving device and is mounted to be rotatable about a main axis that is stationary relative to the frame, an eccentric sleeve which is mounted in an axially movable manner on a pump shaft section, an anti-rotation element which is effective between the pump shaft section and the eccentric sleeve, several pump devices which are stationary relative to the frame and are provided with displacement elements that can be moved in a radial direction relative to the main axis, act upon a fluid contained in swept volumes of the pump devices, and are moved against a fluid pressure by an external surface of the eccentric sleeve, and at least one spring element which acts upon the eccentric sleeve in an axial direction and is formed by a compression spring or tension spring supported on the pump shaft, wherein the pump shaft section is designed as an inclined eccentric pin that has an eccentric pin axis which extends at an oblique angle from the main axis and the eccentric sleeve that is guided on the eccentric pin has a cylindrical external surface, the generatrices of which extend parallel to the main axis wherein the axial displaceability of the eccentric sleeve on the eccentric pin is restricted at least in one direction by an axially fixed stop element and a start position is defined thereby and the eccentric sleeve is pretensioned in the start position by the spring element against the stop element and the external surface of the eccentric sleeve in the start position has a maximum eccentricity with respect to the main axis.

2. The pump according to claim 1, wherein the eccentric pin axis intersects the main axis.

3. The pump according to claim 1, wherein a central axis of the external surface intersects the eccentric pin axis.

4. The pump according to claim 1, wherein the eccentric pin is designed as a circular cylinder section with the eccentric pin axis as a circular cylinder axis.

5. The pump according to claim 1, wherein the spring element comprises a spring rate selected so that on displacing the eccentric sleeve from the start position the increase in the spring force exerted by the spring element is greater than the reduction of the axial component of centrifugal force acting on the eccentric sleeve.

6. The pump according to claim 1, wherein the angle of inclination between the main axis and eccentric pin axis is selected from a range with a lower limit of 3° and an upper limit of 20°.

7. The pump according to claim 1, wherein the anti-rotation element is formed by a featherkey connection running parallel to the eccentric pin axis.

8. The pump according to claim 1, wherein the eccentric pin is arranged to overhang on one end of the pump shaft.

9. The pump according to claim 1, wherein the eccentric pin is arranged on a circular cylinder crank cheek of the pump shaft.

10. The pump according to claim 1, wherein the eccentric sleeve comprises a cylindrical roller bearing including an the external ring of which forms the external surface of the eccentric sleeve.

11. The pump according to claim 1, wherein along the pump shaft several eccentric pins are arranged in particular rotationally symmetrically with respect to the main axis, and each eccentric pin is assigned its own group of pump devices.

12. The pump according to claim 1, wherein the frame is designed as a housing, and the pump devices are arranged in the housing containing a lubricant supply and the pump shaft passes through the housing in a sealed manner.

13. The pump according to claim 12, wherein the lubricant supply is formed by the pressure medium to be conveyed.

14. The pump according to claim 1, wherein the pump devices comprise spring elements or piston springs, which pretension the displacement elements radially in the direction of the main axis against the external surface of the eccentric sleeve.

15. The pump according to claim 1, wherein between the displacement spaces in the pump devices and a pressure medium supply suction valves.

16. The pump according to claim 1, wherein pressure valves comprising disc bearing valves are arranged between the displacement spaces in the pump devices and a high-pressure connection of the eccentric pump.

17. The pump according to claim 1, comprising a gate control, wherein a pressure medium inflow or a pressure medium outflow is controlled in or out of the displacement spaces of the pump devices by the gate control.

18. The pump according to claim 1, wherein the displacement elements comprise a pump pistons guided in pump cylinders.

19. A method for driving a fluid-driven motor hydraulic cylinder or a hydraulic motor by means of a pressure medium flow, wherein the pressure medium flow is provided by a pump according to claim 1.

20. A salvage device, comprising a hydraulic system and salvage cutters driven by the latter or a salvage spreader, wherein the hydraulic system comprises a pump according to claim 1.

* * * * *

UNITED STATES PATENT AND TRADEMARK OFFICE

CERTIFICATE OF CORRECTION

PATENT NO. : 8,322,997 B2
APPLICATION NO. : 12/664971
DATED : December 4, 2012
INVENTOR(S) : Johann Auer and Stefan Kopf It is certified that error appears in the above-identified patent and that said Letters Patent is hereby corrected as shown below:

On the Title Page, Item (57) in the Abstract, line 7, after "section and the eccentric sleeve" delete ")".

In the Specification
Column 2, line 43, after "manufacture" delete ",".
Column 3, line 21, after "possible" delete ",".

In the Claims
Claim 10, Column 13, line 27, after "including an" delete "the".
Claim 15, Column 14, line 12, after "claim 1, wherein" insert --,--.
Claim 15, Column 14, line 14, after "medium supply" insert --,--.
Claim 15, Column 14, line 14, after "valves" insert --are arranged--.
Claim 18, Column 14, line 24, after "elements comprise" delete "a".

Signed and Sealed this
Twenty-third Day of September, 2014

Michelle K. Lee

Michelle K. Lee
*Deputy Director of the United States Patent and Trademark Office*